US010156826B2

(12) United States Patent
Chueh

(10) Patent No.: US 10,156,826 B2
(45) Date of Patent: Dec. 18, 2018

(54) IMAGE FORMING APPARATUS HAVING TWO PRINT HEAD MOUNTING SPACES

(71) Applicant: AVISION INC., Hsinchu (TW)

(72) Inventor: Chuang-Hua Chueh, Hsin Chu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/867,644

(22) Filed: Jan. 10, 2018

(65) Prior Publication Data

US 2018/0210367 A1 Jul. 26, 2018

(30) Foreign Application Priority Data

Jan. 25, 2017 (TW) ..... 106102812 A

(51) Int. Cl.
*G03G 21/00* (2006.01)
*G03G 21/16* (2006.01)

(52) U.S. Cl.
CPC . *G03G 21/1666* (2013.01); *G03G 2221/1636* (2013.01)

(58) Field of Classification Search
CPC ..... G03G 15/04045; G03G 15/04054; G03G 15/04063; G03G 15/04072; G03G 21/1666; G03G 2215/0404; G03G 2215/0407; G03G 2215/0409; G03G 2215/0412; G03G 2215/0414; G03G 2215/0421; G03G 2215/1636
USPC ..... 399/4, 5, 118; 347/138, 152, 257, 263
See application file for complete search history.

(56) References Cited

U.S. PATENT DOCUMENTS 6,374,072 B1 * 4/2002 Wiedemer ..... G03G 15/0126 399/223
6,657,650 B1 12/2003 Nodera et al.
6,867,791 B2 * 3/2005 Shimmura ..... G03G 15/04027 347/117
8,755,718 B2 * 6/2014 Ushiozu ..... G03G 15/04054 399/110
9,146,497 B2 9/2015 Nodera et al.
9,459,556 B2 10/2016 Nodera et al.
(Continued)

FOREIGN PATENT DOCUMENTS

CN 103309206 B 5/2016
JP 05289424 A * 11/1993
(Continued)

OTHER PUBLICATIONS

An Office Action from corresponding TW Application No. 106102812 dated Oct. 6, 2017.

*Primary Examiner* — Robert Beatty

(57) ABSTRACT

An image forming apparatus includes a housing, a drum, a toner processing module and a first mounting space. The drum is disposed in the housing. The toner processing module supplies toners to the drum. The first mounting space accommodates a first print head. The first print head provides a light ray to perform a writing operation on the drum. When the first print head is present, the light ray of the first print head disposed in the first mounting space passes through an optical channel of the toner processing module to perform the writing operation on the drum. Thus, the optimum configurations of the print head and the drum can be achieved, to effectively reduce a size of the image forming apparatus and satisfy diversified requirements without spending a high cost.

11 Claims, 5 Drawing Sheets

(56) References Cited

U.S. PATENT DOCUMENTS

| | | | | |
|---|---|---|---|---|
| 9,915,915 | B2 * | 3/2018 | Yokoi | G03G 21/1814 |
| 2001/0009621 | A1 * | 7/2001 | Nakazato | G03G 21/1839 399/111 |
| 2003/0160856 | A1 * | 8/2003 | Araki | G03G 21/1633 347/138 |
| 2013/0243491 | A1 | 9/2013 | Nodera et al. | |
| 2015/0346635 | A1 | 12/2015 | Nodera et al. | |
| 2016/0363887 | A1 | 12/2016 | Nodera et al. | |

FOREIGN PATENT DOCUMENTS

| | | | | | |
|---|---|---|---|---|---|
| JP | 08314238 | A | * | 11/1996 | |
| JP | 09160333 | A | * | 6/1997 | H04N 1/506 |
| JP | 10063062 | A | * | 3/1998 | |
| JP | 2003255807 | A | * | 9/2003 | |
| JP | 2009198912 | A | * | 9/2009 | |
| JP | 2016-194620 | A | | 11/2016 | |
| TW | 200805007 | A | | 1/2008 | |

* cited by examiner

IMAGE FORMING APPARATUS HAVING TWO PRINT HEAD MOUNTING SPACES

CROSS-REFERENCE TO RELATED APPLICATIONS

This application claims priority of No. 106102812 filed in Taiwan R.O.C. on Jan. 25, 2017 under 35 USC 119, the entire content of which is hereby incorporated by reference.

BACKGROUND OF THE INVENTION

Field of the Invention

This disclosure relates to an image forming apparatus, and more particularly to an image forming apparatus, in which one or two print heads can be mounted.

Description of the Related Art

In a conventional machine, such as a printer, a copier, a multi-function peripheral or the like, having a printing module, an optical writing head is usually used to form a latent image on a drum to perform the printing operation. The optical writing head may be a light emitting diode print head (LPH) and a laser scanning unit (LSU) print head. The LPH has a small volume and needs to be close to the drum to operate. The LSU print head has a large volume, and needs to be away from the drum to perform the writing operation. Thus, if one of components of the image forming apparatus can be effectively used to provide an optical channel, the size of the image forming apparatus can be effectively reduced.

In addition, the cost of the LPH is much higher than that of the LSU print head. Thus, some customers may want to designate the LPH, and others customers may want to designate the LSU print head. For different customer levels, the manufacturer must provide the different image forming apparatuses having the two print heads. However, the image forming apparatus designed for the two print heads must have two sets of design structures, so the mold designing and manufacturing cost is increased, and this is disadvantageous to the reduction of the manufacturing cost.

BRIEF SUMMARY OF THE INVENTION

An objective of this disclosure is to provide an image forming apparatus, and more particularly to provide an image forming apparatus having a size that can be effectively reduced, or even an image forming apparatus in which one or two print heads can be mounted.

To achieve the above-identified object, this disclosure provides an image forming apparatus, which includes a housing, a drum, a toner processing module and a first mounting space. The drum is disposed in the housing. The toner processing module supplies toners to the drum. The first mounting space accommodates a first print head, and the first print head provides a light ray to perform a writing operation on the drum, wherein when the first print head is present, the light ray of the first print head disposed in the first mounting space passes through an optical channel of the toner processing module to perform the writing operation on the drum.

The above-mentioned image forming apparatus may further include a second mounting space accommodating a second print head mounted between the drum and the toner processing module.

With the above-mentioned image forming apparatus, the light ray of the print head passes through the optical channel of the toner processing module, this is advantageous to the optimum configurations of the print head and the drum, and a size of the image forming apparatus can be effectively reduced. In addition, the manufacturer can easily provide an image forming apparatus having one or both of the two print heads for different customer levels, so that the manufacturing costs can be reduced, and diversified requirements can be satisfied. Even two print heads can be mounted together on the image forming apparatus to provide the backup function or the function of enabling the user to select one of the print heads.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

In each embodiment of this disclosure, an image forming apparatus provided has a toner processing module having an optical channel to let the light ray of the print head pass through, and this is advantageous to the optimum configurations of the print head and the drum, to the reduction of a size of the image forming apparatus, to the provision of the opportunity for allowing the manufacturer to mount one or both of the two print heads, and to the satisfaction of the diverse requirements of different customer levels.

Figure 1:
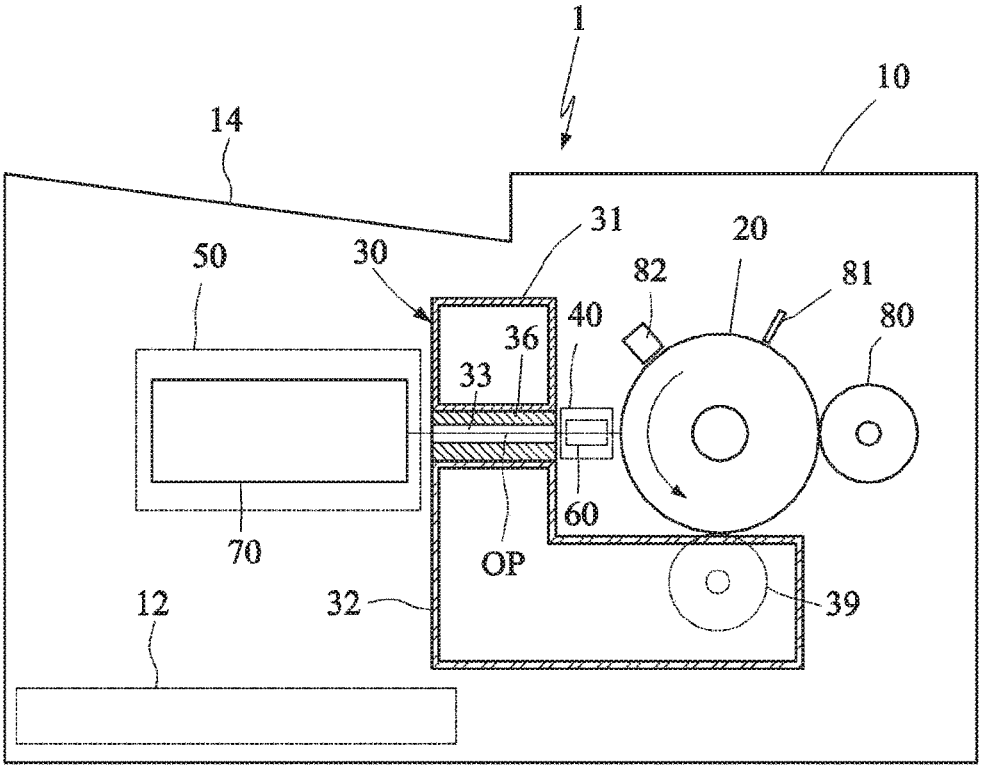
FIG. 1 is a schematic side view showing an image forming apparatus according to a first embodiment of this disclosure.
Figure 2:
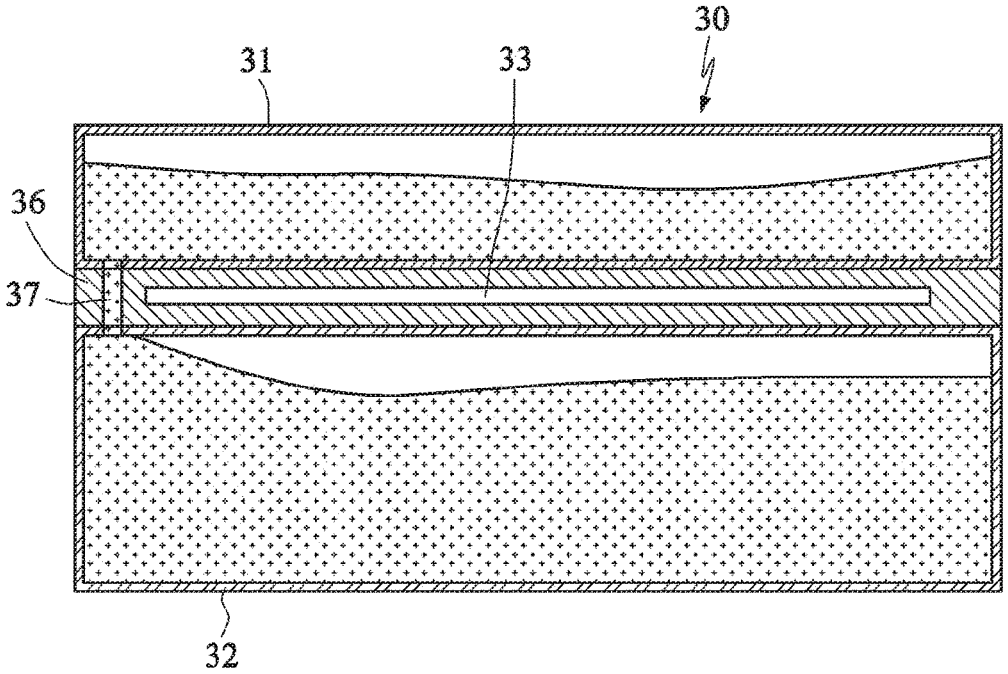
FIG. 2 is schematic front view showing a toner processing module of FIG. 1.

FIG. 1 is a schematic side view showing an image forming apparatus 1 according to the first embodiment of this disclosure. FIG. 2 is schematic front view showing a toner processing module of FIG. 1. As shown in FIGS. 1 and 2, the image forming apparatus 1 of this embodiment may be a printer, a copier or a multi-function peripheral. The image forming apparatus 1 includes a housing 10, a drum 20, a toner processing module 30 and a first mounting space 50.

The drum 20 is disposed in the housing 10, and rotatable relative to the housing 10.

The toner processing module 30 supplies toners to the drum 20. The toner processing module 30 includes a toner supply cartridge 31, a toner processing cartridge 32 and a receptacle 36.

The toner supply cartridge 31 contains the toners. In a preferred design, a user or a maintenance man may replace the toner supply cartridge 31 with a new one to supply the toners.

The toner processing cartridge 32 communicates with the toner supply cartridge 31, receives the toners from the toner supply cartridge 31, processes the toners, and supplies the toners to the drum 20. In one example, the toners are processed (e.g., stirred and mixed) by a stirring mechanism provided in the toner processing cartridge 32, and the toners are supplied to the drum 20 by a development roller 39 disposed in the toner processing cartridge 32.

The receptacle 36 connects the toner processing cartridge 32 to the toner supply cartridge 31, and has a toner channel 37 and an optical channel 33. The toner channel 37 communicates with the toner processing cartridge 32 and the toner supply cartridge 31 to allow the toners to flow from the toner supply cartridge 31 to the toner processing cartridge 32.

The first mounting space 50 accommodates a first print head 70 mounted therein. The first mounting space 50 may be defined by the housing 10. The housing 10 is formed with a structure, such as a slot, a screw hole, a positioning structure or the like, for mounting the first print head 70. In addition, with the above-mentioned configuration, it is also possible to realize an image forming apparatus, in which one or two print heads can be mounted. In this case, the image forming apparatus 1 further includes a second mounting space 40, which accommodates a second print head 60 mounted between the drum 20 and the toner processing module 30. The second mounting space 40 may be defined by the housing 10. The housing 10 is formed with a structure, such as a slot, a screw hole, a positioning structure or the like, for mounting the second print head 60.

The second print head 60 or the first print head 70 provides a light ray to perform a writing operation on the drum 20. The first mounting space 50 is configured such that when the first print head 70 is present, the light ray of the first print head 70 passes through the optical channel 33 of the toner processing module 30 to perform the writing operation on the drum 20. The first print head 70 is, for example, a laser scanning unit (LSU) print head. Because the LSU print head needs a longer optical path, the optical path is configured to pass through the toner processing module 30 in this embodiment, and no extra space is required to provide a portion of the optical path. So, it is advantageous to the optimum configurations of the print head and the drum, and to the reduction of the size of the image forming apparatus.

In this embodiment, the second print head 60 is mounted in the second mounting space 40, but the first print head 70 is not mounted in the first mounting space 50. In addition, the second print head 60 is a light emitting diode print head (LPH), has the property of a small volume, and may be accommodated in the small second mounting space 40. In addition, the second mounting space 40 is designed such that the second print head 60 is disposed on an optical path OP of the light ray of the first print head 70.

In addition, the image forming apparatus 1 may further include a transfer roller 80, a cleaner 81 and a charger 82. The cleaner 81 performs a cleaning process on the drum 20, the charger 82 performs a charging process on the drum 20, and the transfer roller 80 transfers the toners on the drum 20 to the print sheet or medium. Furthermore, the image forming apparatus 1 may further include a heater roller (not shown) and a pressure roller (not shown), which are disposed downstream of the transfer roller 80 and perform a fixation process on the print sheet or medium.

Figure 3:
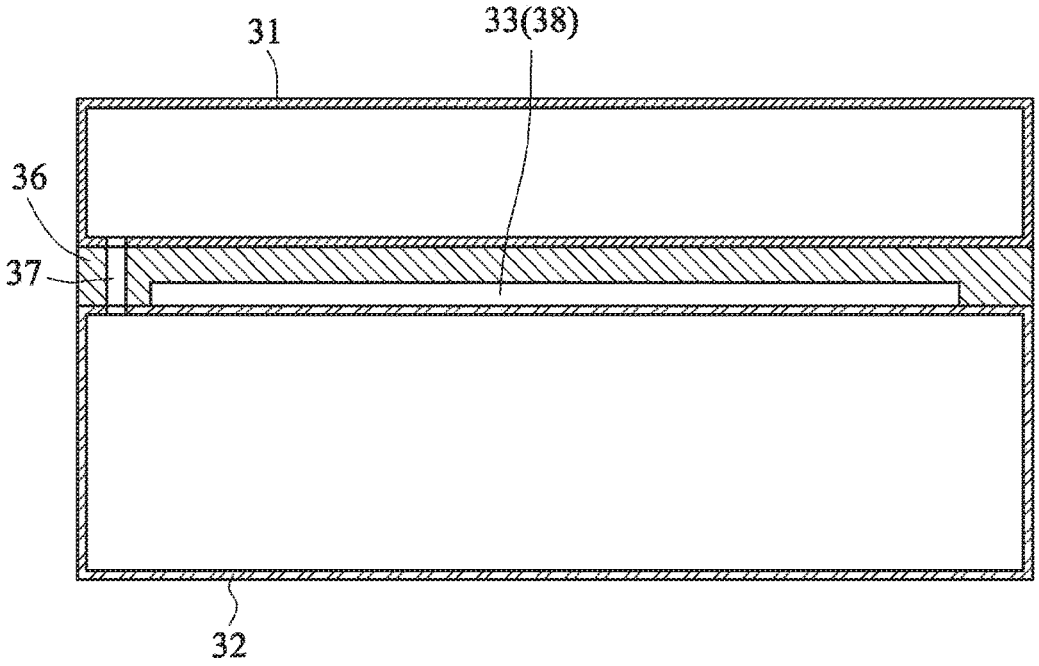
FIGS. 3 to 6 are schematic views showing four modified examples of the toner processing module of FIG. 2.

FIG. 3 to FIG. 6 are schematic views showing four modified examples of the toner processing module of FIG. 2. As shown in FIG. 3, the receptacle 36 connects the toner processing cartridge 32 to the toner supply cartridge 31, and has the toner channel 37 and a slot 38. The slot 38 and the toner processing cartridge 32 form the optical channel 33, and the structure can decrease the height of the optical channel 33.

Figure 4:
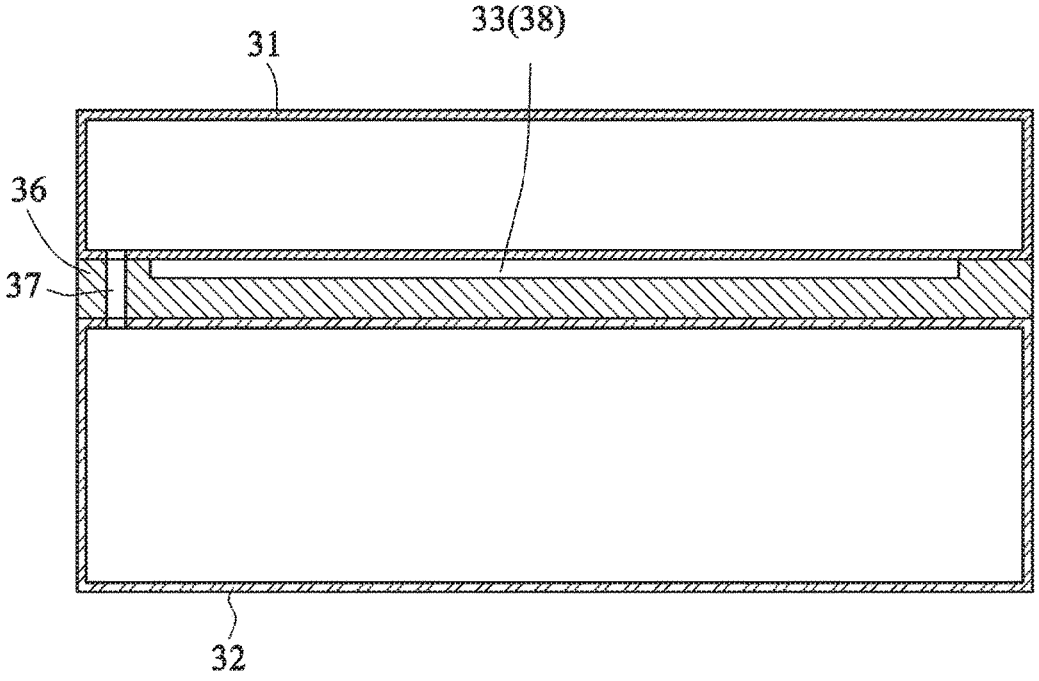

The structure of FIG. 4 is similar to that of FIG. 3 except for the difference that the slot 38 and the toner supply cartridge 31 form the optical channel 33, and the structure can increase the height of the optical channel 33.

Figure 5:
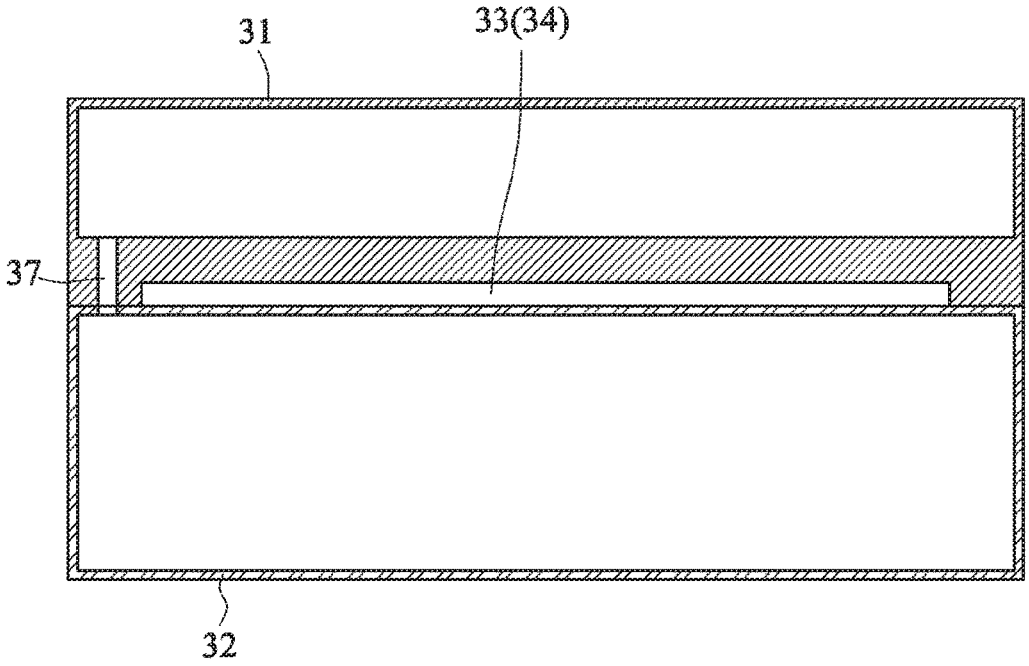

As shown in FIG. 5, the toner processing module 30 includes the toner supply cartridge 31 and the toner processing cartridge 32, but does not have the receptacle. This is equivalent to the condition where the receptacle is integrated into the toner supply cartridge 31. Thus, the optical channel 33 is formed between the toner supply cartridge 31 and the toner processing cartridge 32, so that the light ray of the first print head 70 passes through the optical channel 33 and reaches the drum 20. In addition, the toner supply cartridge 31 has a concave portion 34, and the concave portion 34 and the toner processing cartridge 32 form the optical channel 33. This design is helpful to the reduction of the number of the parts.

Figure 6:
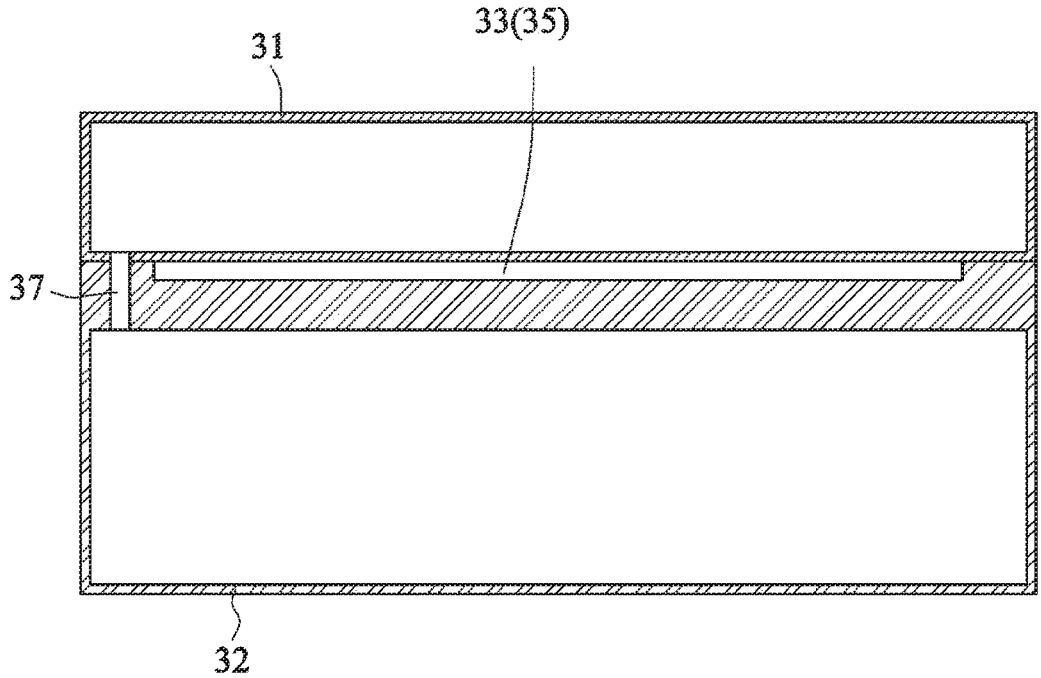

The structure of FIG. 6 is similar to that of FIG. 5 except for the difference that the receptacle is integrated into the toner processing cartridge 32, wherein the toner processing cartridge 32 has a concave portion 35, and the concave portion 35 and the toner supply cartridge 31 form the optical channel 33. This design is helpful to the reduction of the number of the parts.

Figure 7:
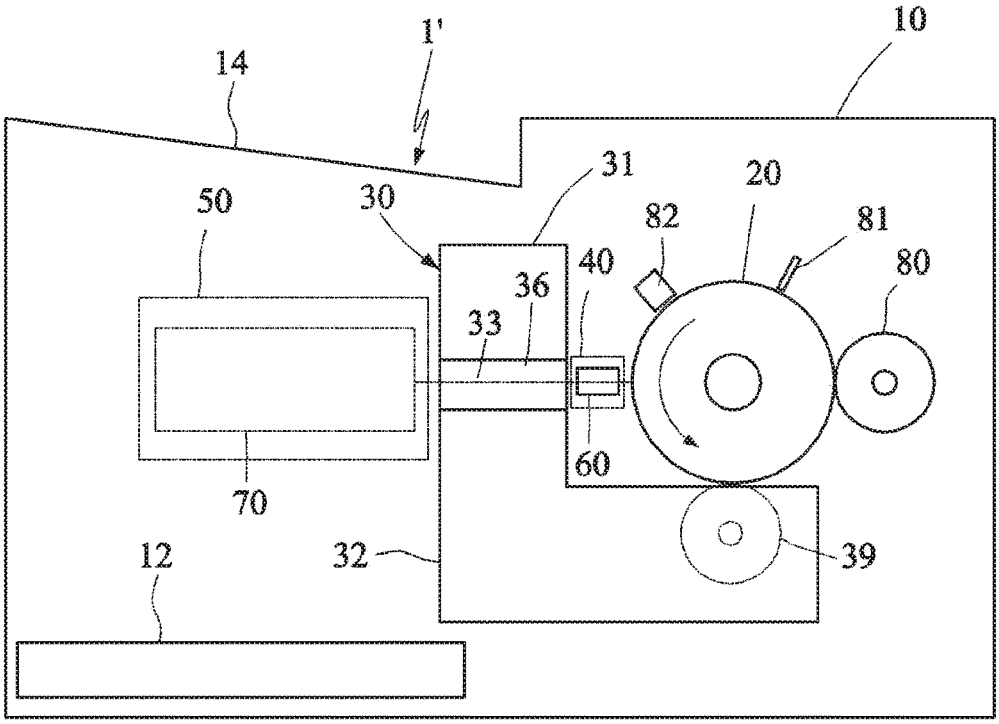
FIG. 7 is a schematic side view showing an image forming apparatus according to a second embodiment of this disclosure.

FIG. 7 is a schematic side view showing an image forming apparatus 1' according to the second embodiment of this disclosure. Referring to FIG. 7, this embodiment is similar to the first embodiment except for the difference that the first print head 70 is mounted in the first mounting space 50, but the second print head 60 is not mounted in the second mounting space 40. The image forming apparatus 1' of FIG. 7 is designed for the customer who needs the first print head 70. The first print head 70 is, for example, the LSU print head having the volume larger than that of the LPH. The LSU print head needs to be mounted in the large first mounting space 50, but an output tray 14 for storing the printed sheets is usually designed above the first mounting space 50, and a supply tray 12 for accommodating the to-be-printed sheets is usually designed below the first mounting space 50. So, the first mounting space 50 may also be regarded as a redundant space when the output tray 14 and the supply tray 12 are present. Thus, the use of the first mounting space 50 does not enlarge the volume of the image forming apparatus 1.

Figure 8:
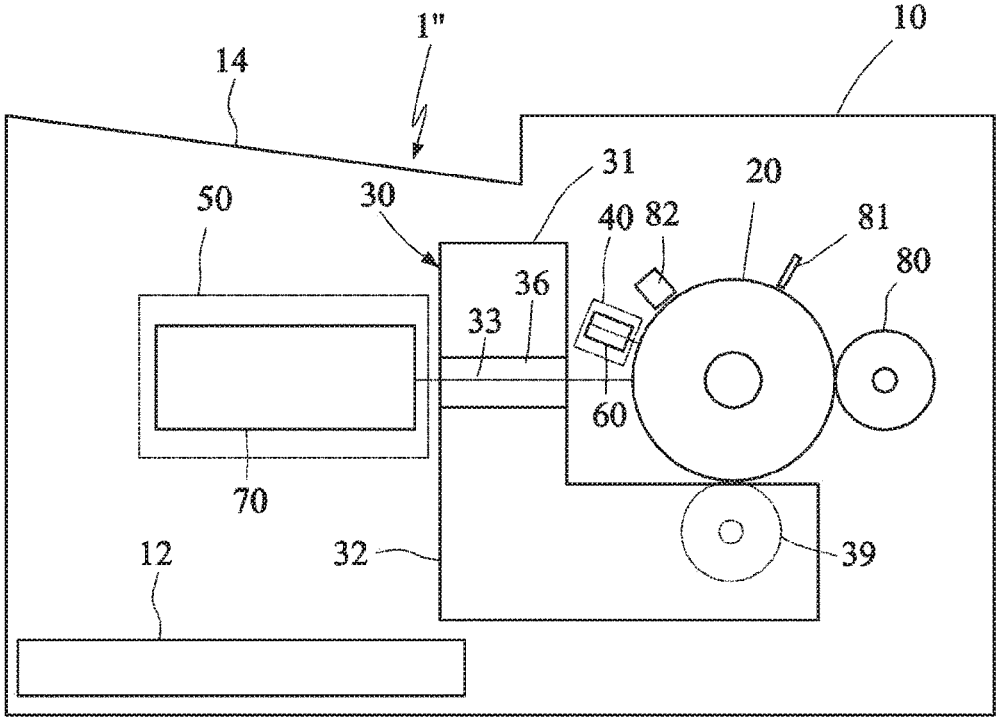
FIG. 8 is a schematic side view showing an image forming apparatus according to a third embodiment of this disclosure.

FIG. 8 is a schematic side view showing an image forming apparatus 1" according to the third embodiment of this disclosure. As shown in FIG. 8, the image forming apparatus 1" includes the second print head 60 and the first print head 70, wherein the second print head 60 is not disposed on the optical path OP of the light ray of the first print head 70. It is worth noting that the architecture, in which the second print head 60 is not disposed on the optical path OP of the light ray of the first print head 70, is also applicable to the case where only one of the second print head 60 and the first print head 70 is present, and this disclosure is not particularly restricted thereto.

Figure 9:
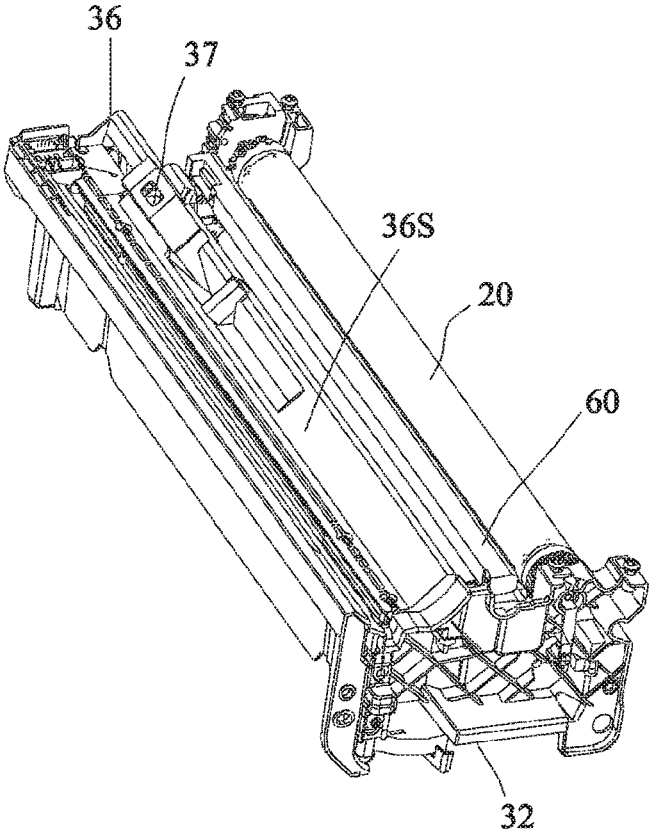
FIGS. 9 and 10 are a partial pictorial view and a partial front view showing an image forming apparatus according to a fourth embodiment of this disclosure.
Figure 10:
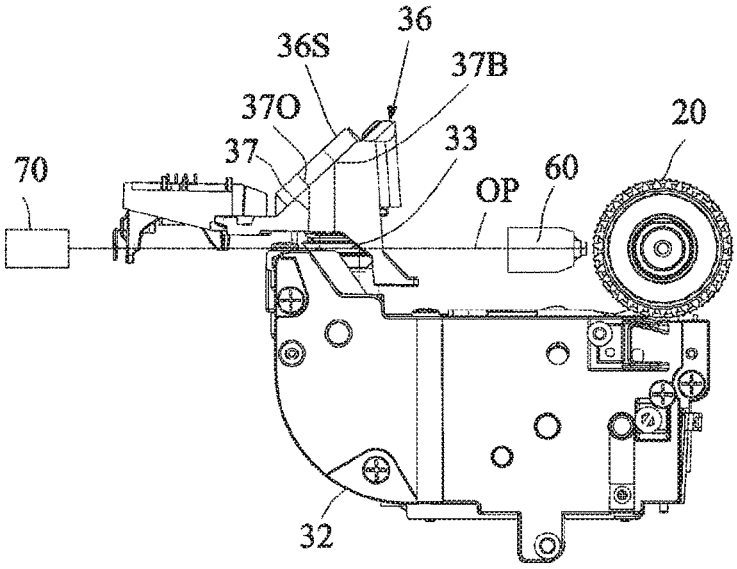

FIGS. 9 and 10 are a partial pictorial view and a partial front view showing an image forming apparatus according to the fourth embodiment of this disclosure. As shown in FIGS. 9 and 10, an opening 370 of the toner channel 37 is formed on an inclined surface 36S of the receptacle 36, and the inclined surface 36S is not perpendicular to the optical path OP of the optical channel 33. Thus, the toner channel 37 has a turning portion 37B. The included angle between the inclined surface 36S and the optical path OP ranges between 0° and 90°, and preferably between 10° and 80°, between 20° and 70° or between 30° and 60°. By the design of the inclined surface 36S, the space between the toner channel 37 or the receptacle 36 and the drum 20 can be enlarged, so that the second print head 60 has the larger movement space and the longer path, and it is advantageous to the repair and the replacement of the drum 20 or the second print head 60, and to the arrangements of other mechanisms (e.g., the support mechanism (not shown) of the second print head 60 and the like).

With the above-mentioned image forming apparatus, the light ray of the print head passes through the optical channel of the toner processing module, this is advantageous to the optimum configurations of the print head and the drum, and a size of the image forming apparatus can be effectively reduced. In addition, the manufacturer can easily provide an image forming apparatus having one or both of the two print heads for different customer levels, so that the manufacturing costs can be reduced, and diversified requirements can be satisfied. Even two print heads can be mounted together on the image forming apparatus to provide the backup function or the function of enabling the user to select one of the print heads.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. An image forming apparatus, comprising:
a housing;
a drum disposed in the housing;
a toner processing module supplying toners to the drum;
a first mounting space for accommodating a first print head, wherein when the first print head is present, the first print head provides a light ray to perform a writing operation on the drum, and the light ray of the first print head disposed in the first mounting space passes through an optical channel of the toner processing module to perform the writing operation on the drum; and
a second mounting space for accommodating a second print head mounted between the drum and the toner processing module, wherein the toner processing module comprises:
a toner supply cartridge containing the toners;
a toner processing cartridge, which communicates with the toner supply cartridge, receives the toners from the toner supply cartridge, processes the toners, and supplies the toners to the drum; and
a receptacle connecting the toner processing cartridge to the toner supply cartridge, wherein the receptacle has a toner channel and the optical channel, and the toner channel communicates with the toner processing cartridge and the toner supply cartridge.

2. The image forming apparatus according to claim 1, wherein:
the second print head is mounted in the second mounting space, and the first print head is not present and not mounted in the first mounting space.

3. The image forming apparatus according to claim 1, wherein the second print head is disposed on an optical path of the light ray of the first print head.

4. The image forming apparatus according to claim 1, wherein the second print head is not disposed on an optical path of the light ray of the first print head.

5. The image forming apparatus according to claim 4, wherein both the second print head and the first print head are present.

6. The image forming apparatus according to claim 1, wherein:
the first print head is mounted in the first mounting space, and the second print head is not present and not mounted in the second mounting space.

7. The image forming apparatus according to claim 1, wherein an opening of the toner channel is formed on an inclined surface of the receptacle, and the inclined surface is not perpendicular to an optical path of the optical channel.

8. An image forming apparatus, comprising:
a housing;
a drum disposed in the housing;
a toner processing module supplying toners to the drum;
a first mounting space for accommodating a first print head, wherein when the first print head is present, the first print head provides a light ray to perform a writing operation on the drum, and the light ray of the first print head disposed in the first mounting space passes through an optical channel of the toner processing module to perform the writing operation on the drum; and
a second mounting space for accommodating a second print head mounted between the drum and the toner processing module, wherein the toner processing module comprises:
a toner supply cartridge containing the toners;
a toner processing cartridge, which communicates with the toner supply cartridge, receives the toners from the toner supply cartridge, processes the toners, and supplies the toners to the drum: and
a receptacle connecting the toner processing cartridge to the toner supply cartridge, wherein the receptacle has a toner channel and a slot, the toner channel communicates with the toner processing cartridge and the toner supply cartridge, and the optical channel is formed by the slot and the toner processing cartridge or by the slot and the toner supply cartridge.

9. An image forming apparatus, comprising:
a housing;
a drum disposed in the housing;
a toner processing module supplying toners to the drum;
a first mounting space for accommodating a first print head, wherein when the first print head is present, the first print head provides a light ray to perform a writing operation on the drum, and the light ray of the first print head disposed in the first mounting space passes through an optical channel of the toner processing module to perform the writing operation on the drum; and a second mounting space for accommodating a second print head mounted between the drum and the toner processing module, wherein the toner processing module comprises:

a toner supply cartridge containing the toners; and a toner processing cartridge, which communicates with the toner supply cartridge, receives the toners from the toner supply cartridge, processes the toners, and supplies the toners to the drum, wherein the optical channel is formed between the toner supply cartridge and the toner processing cartridge, and the light ray of the first print head passes through the optical channel and reaches the drum.

10. The image forming apparatus according to claim 9, wherein the toner supply cartridge has a concave portion, and the concave portion and the toner processing cartridge form the optical channel.

11. The image forming apparatus according to claim 9, wherein the toner processing cartridge has a concave portion, and the concave portion and the toner supply cartridge form the optical channel.

* * * * *